United States Patent [19]

Weiner

[11] 4,187,509

[45] Feb. 5, 1980

[54] WAFER AND FASTENER FOR USE IN ELECTRONIC THEFT DETECTION SYSTEM

[75] Inventor: Arnold Weiner, Brooklyn, N.Y.

[73] Assignee: Knogo Corporation, Hicksville, N.Y.

[21] Appl. No.: 808,362

[22] Filed: Jun. 20, 1977

[51] Int. Cl.[2] ..... G08B 13/00; H01Q 1/36

[52] U.S. Cl. ..... 343/873; 343/895; 340/572

[58] Field of Search ..... 340/258, 280, 572; 343/6.55 SS, 702, 873, 895; 40/20 R, 22

[56] References Cited

U.S. PATENT DOCUMENTS

| | | | |
|---|---|---|---|
| 1,390,342 | 9/1921 | Delay | 40/22 |
| 2,401,472 | 6/1946 | Franklin | 343/873 |
| 2,916,788 | 12/1959 | Carpinella | 40/20 R |
| 3,628,267 | 12/1971 | Minasy | 40/20 |
| 3,678,608 | 7/1972 | Minasy | 40/20 R |
| 3,754,226 | 8/1973 | Fearon | 343/787 |
| 3,911,534 | 10/1975 | Martens et al. | 340/280 |
| 3,914,829 | 10/1975 | Paskert | 340/280 |
| 3,967,161 | 6/1976 | Lichtblau | 340/280 |

FOREIGN PATENT DOCUMENTS

| | | |
|---|---|---|
| 677295 | 8/1952 | United Kingdom . |
| 715475 | 9/1954 | United Kingdom . |
| 884964 | 12/1961 | United Kingdom . |
| 1085704 | 10/1967 | United Kingdom . |

*Primary Examiner*—Eli Lieberman

*Attorney, Agent, or Firm*—Fitzpatrick, Cella, Harper & Scinto

[57] ABSTRACT

A wafer construction which includes an expansive, generally flat plastic member formed with a spiral groove in which an elongated electrical conductor is held in the shape of a coil. The plastic member is also formed with a recess in which a capacitor is contained. The capacitor is connected to both ends of the conductor to form a resonant electrical circuit. A hardened steel reinforcing element is also embedded in the wafer around the wafer circuits to protect them against severing. A tack-like fastener element has a concave head which telescopes over a dome-like projection on the wafer to provide a tamper resistant fastening assembly when the tack shank is inserted into an opening in the wafer.

12 Claims, 10 Drawing Figures

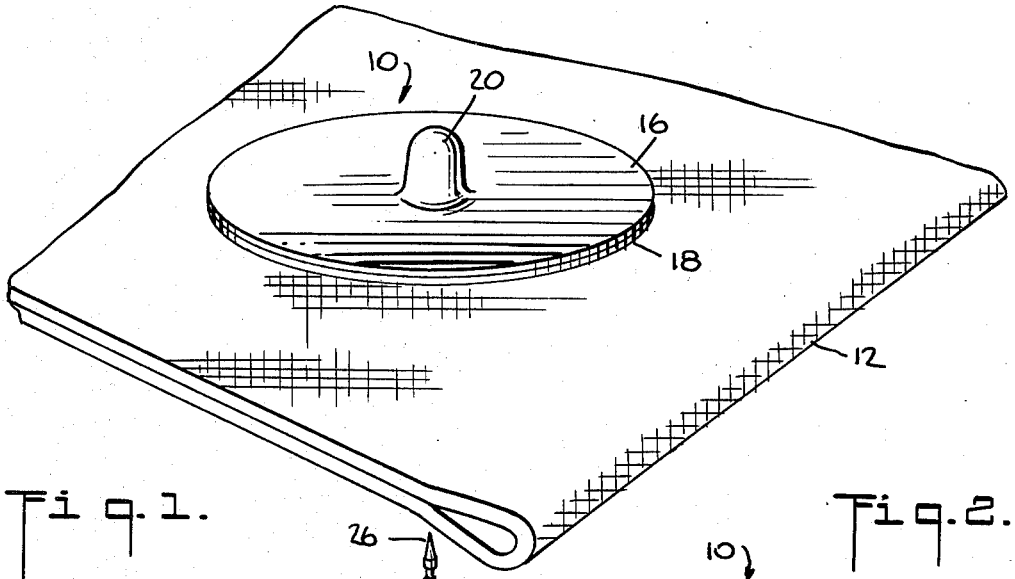
Fig. 1.
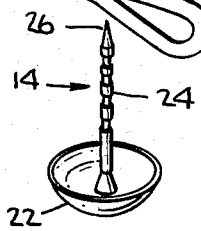
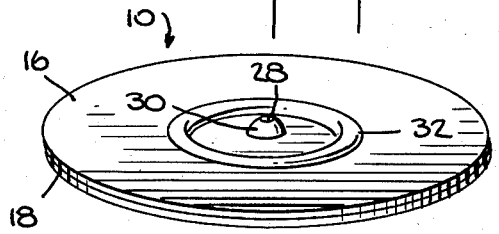
Fig. 2.
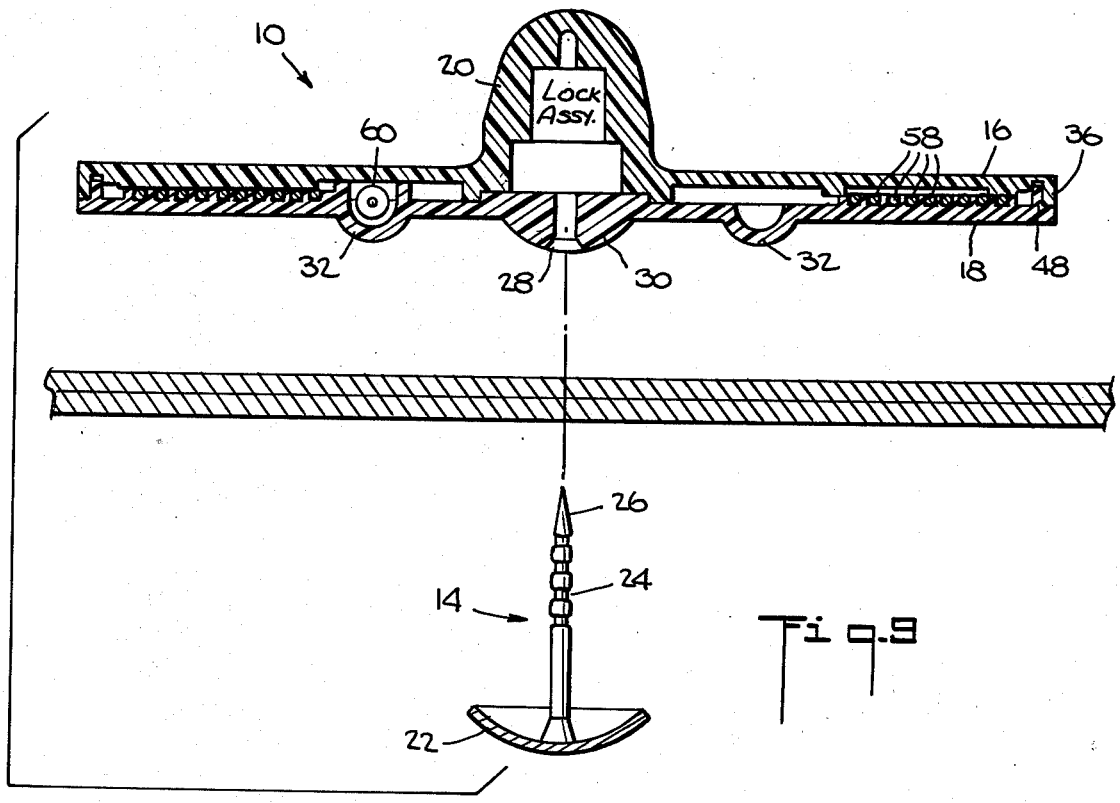
Fig. 3

WAFER AND FASTENER FOR USE IN ELECTRONIC THEFT DETECTION SYSTEM

BACKGROUND OF THE INVENTION

1. Field of the Invention

This invention relates to target assemblies for electronic theft detection systems and more particularly it concerns novel wafers which contain electronic target circuits and which can be temporarily attached to articles of merchandise.

2. Description of the Prior Art

In U.S. Pat. No. 3,500,373 there is described an electronic theft detection system which may be used in a retail store to protect articles of merchandise from theft. As described in that patent, a wafer is provided for each article to be protected. The wafer is a generally flat, plastic element which contains a frequency selective electronic circuit and which can be temporarily, but securely, attached to the article. If any article of merchandise, having such a wafer attached to it, is carried through a checkpoint or interrogation zone, such as at or near the store exit, the electronic circuit in the wafer will react with an electromagnetic interrogation field in the checkpoint zone and will cause an alarm to be sounded.

The wafers of the prior art have been of laminate construction, comprising upper and lower flat plastic elements with recesses in their mutually facing surfaces. A prewound coil of insulated electrical wire is provided with a capacitor connected across its ends to form a resonant electrical circuit; and the coil-capacitor assembly is laid in the recesses of one of the plastic elements before the elements are superimposed on each other and heat welded together. One of the plastic elements is also provided with a housing in which a tack shank gripping mechanism, or lock, is fitted. The other element is provided with the gripping mechanism so that the shank of a tack-like fastener can be inserted into the gripping mechanism.

In some prior art wafer constructions the tack-like fastener is secured by means of a "Tinnerman" type element to one end of an arm which is hinged at its other end to the edge of the wafer. The head of the fastener is countersunk into a recess formed in the arm and mutually facing abutments are provided on the arm and on the wafer surrounding the tack shank. These prior art wafer constructions, however, are susceptible to tampering and unauthorized removal because it is sometimes possible, by pulling back slightly on the fastener or on the material to which it is attached, to expose enough of its shank so that a severing tool can be inserted and applied to the shank.

SUMMARY OF THE INVENTION

The present invention, according to one feature thereof, provides a novel theft detection target wafer construction which is characterized by low material and assembly costs and high electrical performance. This novel wafer construction includes a substantially flat expansive element formed with a continuous spiral shaped coil groove and a capacitor recess. An elongated electrical conductor is fitted into the groove and is held in place thereby to form a coil. A capacitor is fitted into the capacitor recess, and its leads are connected to the ends of the coil to form a resonant electrical circuit. A second expansive element is then laminated over the first element to enclose the resonant electrical circuit.

The provision of a preformed spiral groove permits the use of non-insulated wire which is considerably less expensive than insulated wire.

According to a further feature of the present invention there is provided a novel theft detection target wafer construction which is characterized by a high degree of resistance to tampering and unauthorized removal attempts. This novel wafer construction includes a substantially flat expansive element containing an enclosed electrical circuit and a tack shank gripping mechanism. An opening is provided on one side of the element for admitting a tack shank into the gripping mechanism; and a projection, in the form of a dome-like bulge, is formed on the surface of the element surrounding the opening. The tack-like fastener itself is provided with a tack head having a concave underside which generally conforms to and fits over the projection so that the projection, along with the material to which the wafer is fastened, may telescope into the fastener head. This arrangement prevents access to the region of the fastener shank adjacent the head, even if the fastener is pulled out slightly and even if the material is drawn back tightly around the fastener head. Accordingly, one cannot sever the fastener shank by means of a thin tool inserted under the fastener head.

According to a still further feature of this invention a wafer, in which an electronic circuit is embedded for use in an electronic theft detection system, is protected by an elongated reinforcing member which is of hardened metal, such as steel. The reinforcing member is also embedded in the wafer and it substantially surrounds the wafer circuit to protect it from damage due to attempted cutting or severing of the wafer.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying the purposes of this invention. It is important, therefore, that this disclosure be regarded as including such equivalent arrangements as do not depart from the spirit and scope of the invention.

BRIEF DESCRIPTION OF THE DRAWINGS

Preferred embodiments of the invention have been chosen for purposes of illustration and description, and are shown in the accompanying drawings forming a part of the specification, wherein:

FIG. 1 is a perspective view of a wafer according to the present invention about to be fastened to an article of merchandise;

FIG. 2 is a perspective view of the underside of the wafer of FIG. 1;

FIG. 9 is a side elevational view, taken in section, of the wafer, article of merchandise and fastener of FIG. 1 prior to assembly.

DETAILED DESCRIPTION OF THE PREFERRED EMBODIMENTS

Figure 3:
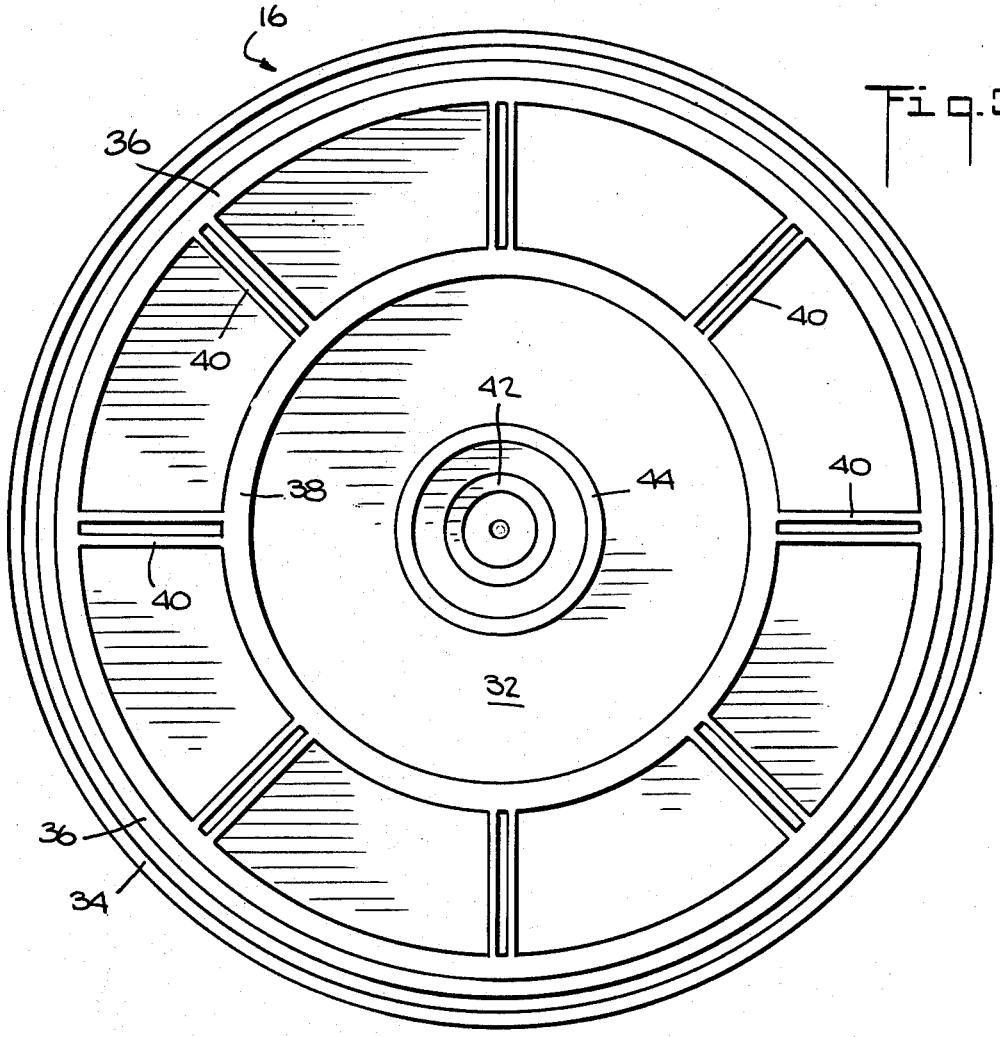
FIG. 3 is a plan view of the inside surface of an upper portion of the wafer of FIG. 1.

As shown in FIG. 1 a wafer 10 is arranged to be fastened to an article of merchandise 12, by means of a tack-like fastener 14 which pierces the merchandise and enters into and is gripped by the wafer.

The wafer 10 is a molded plastic assembly which contains a resonant electrical circuit. This circuit cooperates with electronic detecting equipment such as shown in U.S. Pat. No. 3,500,373 so that the equipment produces an alarm signal whenever the merchandise 12 bearing the wafer 10 is brought through a special checkpoint or interrogation region. When a legitimate purchase is made, the wafer 10 is removed by means of a special tool and the merchandise then can be brought through the checkpoint without setting off the alarm.

The wafer 10, as shown in FIG. 1, is formed of upper and lower molded plastic members 16 and 18 of disc-like configuration laminated to each other. In the center of the upper member 16 there is formed a dome shaped lock housing 20 which contains a mechanism for gripping the fastener 14. The fastener 14 in turn is made up of a crown shaped head 22 and a thin elongated shank 24 with a pointed tip 26. As can be seen, the shank passes through the article of merchandise 12 and passes into the center of the wafer 10; and it is held tightly by the locking mechanism inside the lock housing 20.

FIG. 2 shows the underside of the wafer 10. The underside of the wafer 10 is also generally flat except that it contains a central opening 28 for receiving the fastener shank 24, and a rounded dome-like projection 30, which surrounds the opening 28. In addition, a rounded ridge 32 extends circularly around the projection 30.

Figure 4:
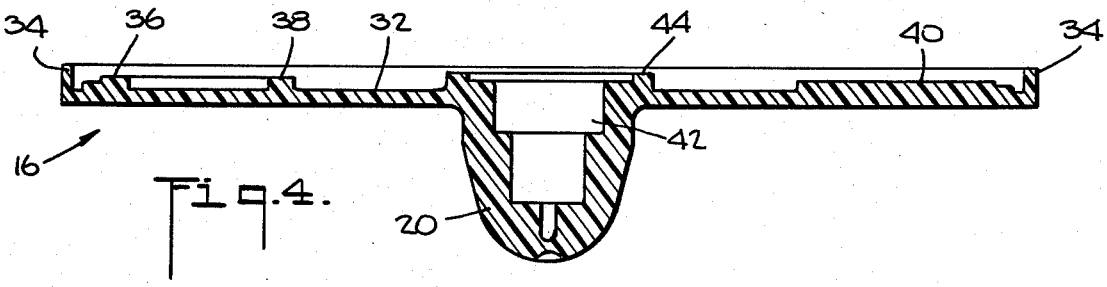
FIG. 4 is a section view taken along line 4—4 of FIG. 3.

FIGS. 3 and 4 show the construction of the upper member 16 in greater detail. As can be seen, the member 16 is formed with a generally flat disk shaped wall 32 with a peripheral flange 34 extending from the inner surface thereof. There are also formed concentric circular abutments 36 and 38 along the inner surface of the member 16 and spaced apart radial abutments 40 extend between these circular abutments. The lock housing 20 (FIG. 4), is molded integrally with the upper member 16. As shown, there is provided a cavity 42 in the lock housing for accommodating the mechanism which grips the fastener shank. This cavity opens to the inner surface of the member 16. The specific gripping mechanism contained in the cavity is not important to this invention and accordingly it is not described herein. Suitable gripping mechanisms are shown in U.S. Pat. No. 3,911,534 (now disclaimed). An inner circular abutment 44 surrounds the cavity 42.

As will be seen more fully hereinafter, the outer peripheral flange 34 and the various abutments 36, 38, 40 and 44 cooperate with corresponding elements of the lower member 18 to define hollow interior regions of the wafer while at the same time maintaining a very rigid and tamper-resistant structure. Thus the electronic circuit contained within the wafer is well protected from tampering.

Figure 5:
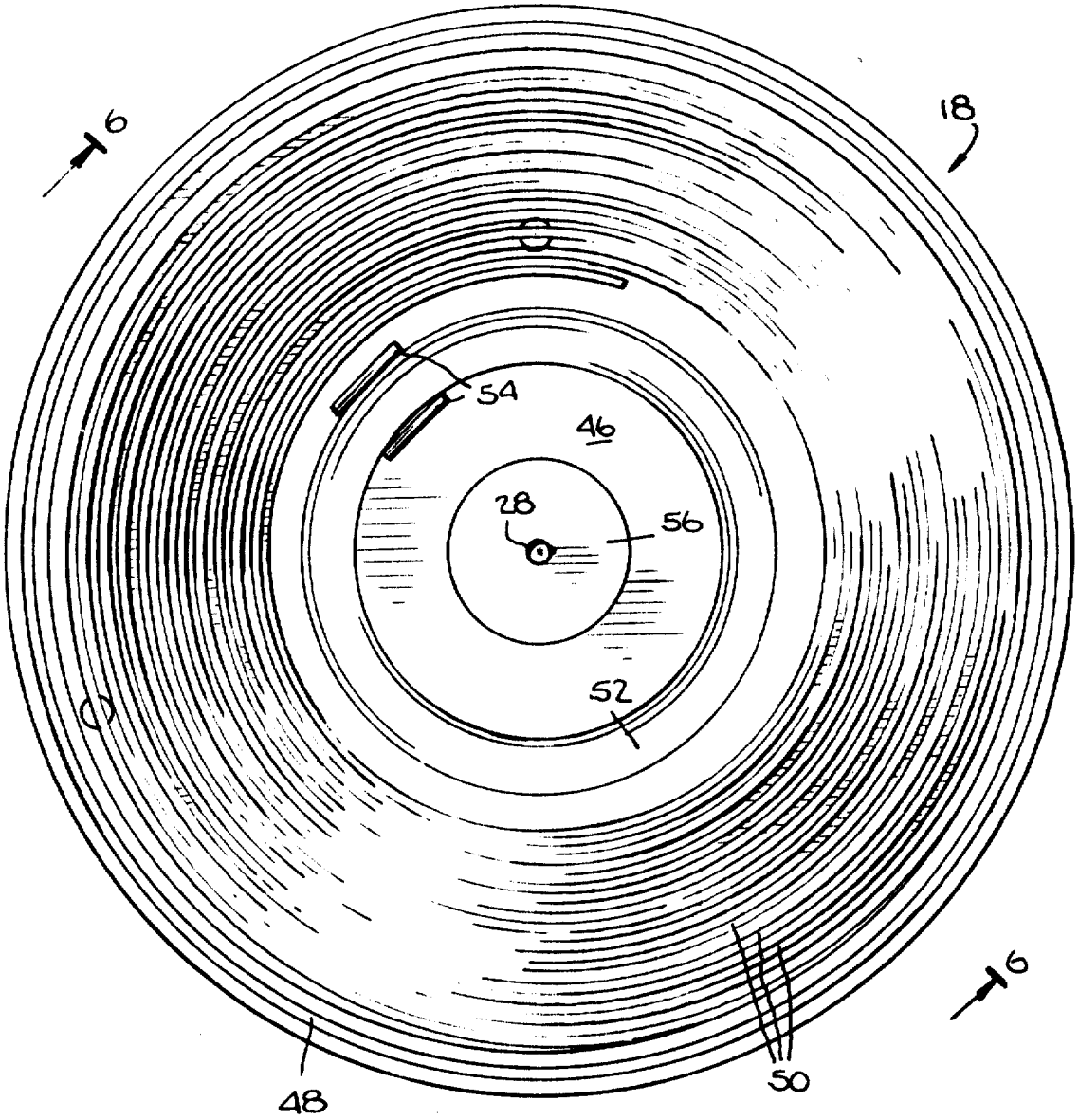
FIG. 5 is a plan view of the inside surface of a lower portion of the wafer to FIG. 1.
Figure 6:
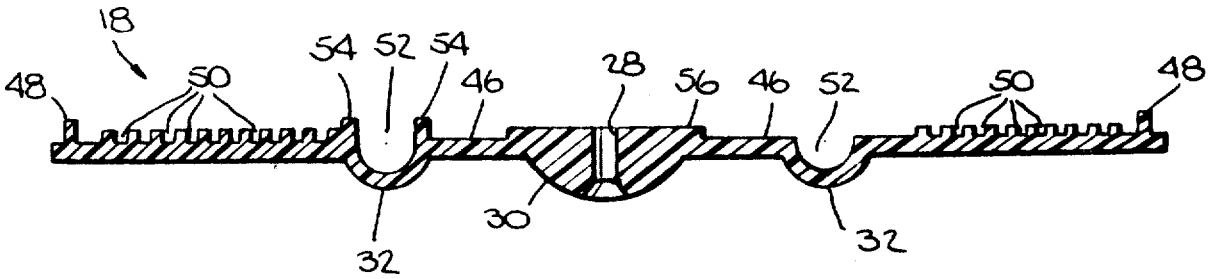
FIG. 6 is a section view taken along line 6—6 of FIG. 5.

FIGS. 5 and 6 show the construction of the lower member 18. The lower member 18 is similar in construction to the upper member 16; and it is also formed with a generally flat, disk shaped wall 46 with a flange 48 located slightly inside its periphery on its inner surface. The flange 48 is dimensioned and arranged to telescope with the flange 34 of the upper member 16 in assembly. The inner surface of the wall 46 is also formed with a spiral groove 50 in the region corresponding to the region between the circular abutments 36 and 38 of the upper member 16. The spiral groove 50 is a single continuous groove of generally square cross section; and, as shown in the drawings, it contains approximately ten complete turns. For the detection system of U.S. Pat. No. 3,500,373 and for operation at a frequency of about two megahertz, the size and pitch of the groove 50 is such that its larger diameter is about three inches (7.6 cm.) and its smaller diameter is about one and one half inches (3.8 cm.). The rounded ridge 32 (FIG. 2) is formed on the outer surface of the lower member 18 just inside the region of the spiral groove 50. A corresponding rounded channel 52 is formed on the inner surface of the lower member 18 at the location of the ridge 32. A pair of capacitor support walls 54 extend up from opposite sides of the channel 52 for a short distance therealong. Also as shown, the central opening 28 extends through the lower member 18 and it is surrounded, on the outer surface of the member (FIG. 6), by the rounded projection 30. An inner central abutment 56 extends up from the wall 46 to rest against the upper member 16 just inside the inner circular abutment 44 in assembly.

Figure 7:
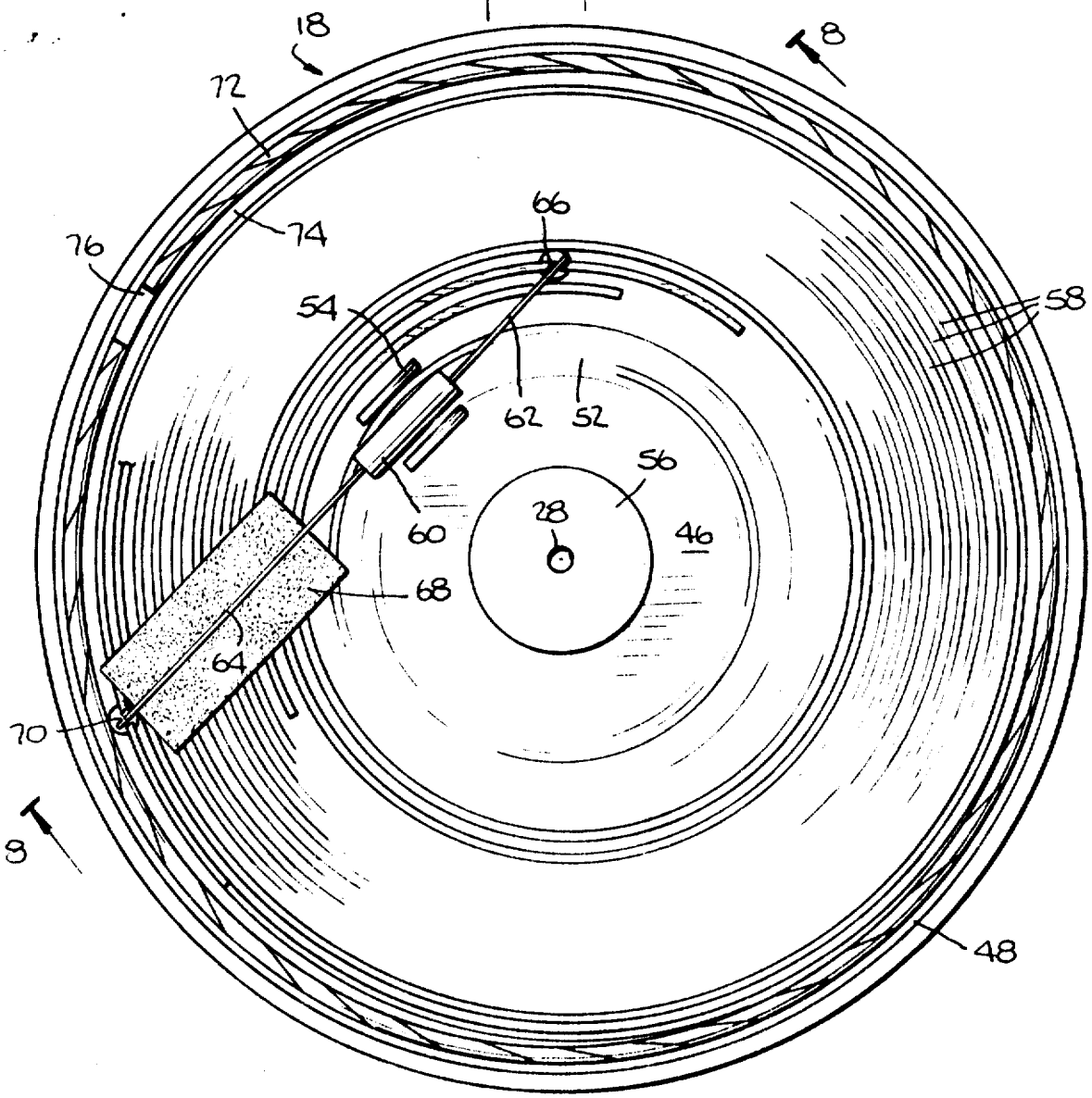
FIG. 7 is a view similar to FIG. 5, but showing an electrical circuit held in place in the lower portion of the wafer.
Figure 8:
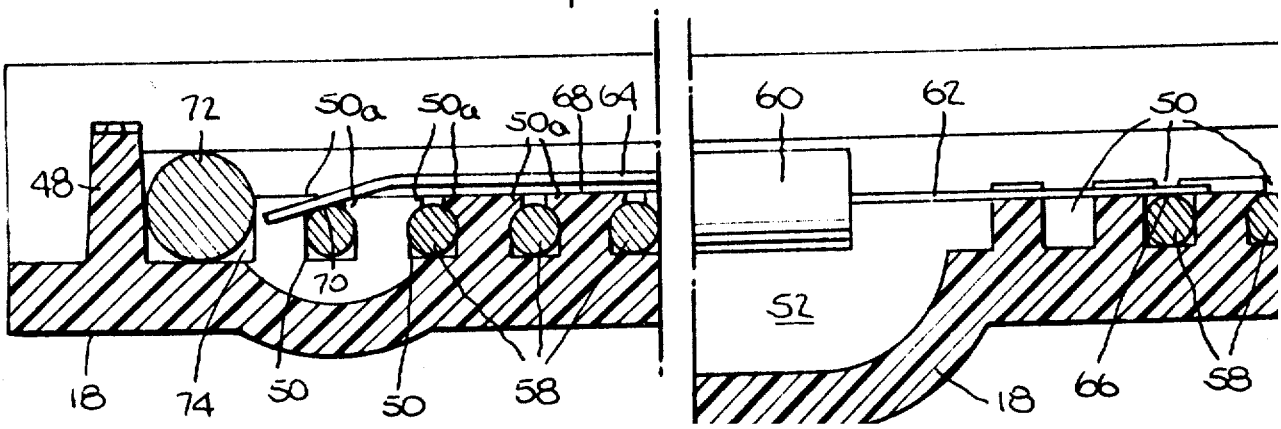
FIG. 8 is a section view taken along 8—8 of FIG. 7 but showing the upper and lower portions of the wafer in assembly.

As shown in FIGS. 7 and 8, a coil 58 is provided on the inner surface of the lower member 18. The coil 58 comprises an elongated electrical conductor positioned in and held by the walls of the spiral groove 50. A capacitor 60 is positioned in the channel 52 between the support walls 54. The capacitor 60 is provided with a pair of elongated wire leads 62 and 64 which extend chordally along the coil 58. The lead 64 extends across the tops of the groove 50 to the outermost turn and it is electrically connected to the outer portion of the coil 58 by a weldment 70. In order to prevent short circuiting of the intermediate turns of the coil 58 by the capacitor lead 64 a thin sheet 68 of insulating material, such as a piece of masking tape, is placed over the region of the coil across which the lead 64 extends. The other lead 62 of the capacitor 60 is shorter; and it is electrically connected to the innermost turn of the coil 58 by a weldment 66.

As can be seen in FIG. 8 the coil 58 fits tightly into the groove 50. In some cases it may be desirable to peen over the upper regions of the groove 50, as shown at 50*a*, to ensure that the coil will be held in place.

After the coil 58 and the capacitor 60 have been assembled and connected together in the lower member 18, the upper member 16, with a suitable lock arranged in the cavity 42, is placed over the lower member, as shown in FIG. 9, and is welded in place, for example, by ultrasonic welding. This causes the peripheral flanges 34 and 48 to become sealed together to encapsulate the coil and capacitor. The welding operation also serves to make the overall structure quite rigid.

It will be noted that the coil 58 which is held in place by the spiral groove 50 is not insulated. The wafer material itself provides the necessary insulation between adjacent turns of the coil. Because non-insulated wire can be used in this wafer, its cost of construction is considerably reduced in comparison to the cost of wafers incorporating coils made of insulated wire. In fact, because the physical structure of the wafer itself provides the necessary insulation between adjacent turns of the coil 58 the diameter of the coil wire can be made large without adding to insulation costs. This permits the use of wire, such as aluminum, which has a higher resistance but a much lower cost than copper. In the presently preferred construction it is preferred to employ aluminum wire of 0.030 inches (7.6 mm) diameter for the coil 58.

It will further be appreciated that the wafer of the present invention provides structural support to maintain the coil shape. Therefore, the electrical characteristics of the resonant circuit formed by the coil and capacitor can be accurately maintained.

FIGS. 7 and 8 show an additional feature which enhances the security provided by the wafer 10. As there shown, a split ring 72 of hardened steel wire is positioned in a groove 74 just inside the flange wall 48, that is, just surrounding the coil 58. The ring 72 should be essentially co-planar with the coil 58 and it should have a wire diameter at least as great, and preferably greater, than that of the wire from which the coil 58 is formed. Thus, in the present embodiment a ring wire diameter of approximately 0.045 inches (11.4 mm) is adequate.

When the upper and lower members 16 and 18 are assembled, the ring 72 provides an embedded reinforcement which protects the coil 58 from damage due to shearing or cutting with a tool which might otherwise sever the wafer and coil material. It will be appreciated that the ring 72 renders the wafer practically tamperproof.

The ring 72 is not in the form of a complete circle but instead its ends terminate a finite distance from each other to form a gap 76. This gap serves to prevent the ring from adversely affecting the electrical characteristics of the wafer. Although the reinforcing effect of the ring 72 is absent in the region of the gap 76, the gap may be made quite small, e.g., 0.125 inches (0.32 mm); and, since the ring is concealed within the wafer, its location cannot be ascertained. Accordingly, the gap 76 does not appreciably detract from the reinforcing effect of the ring 72.

Figure 10:
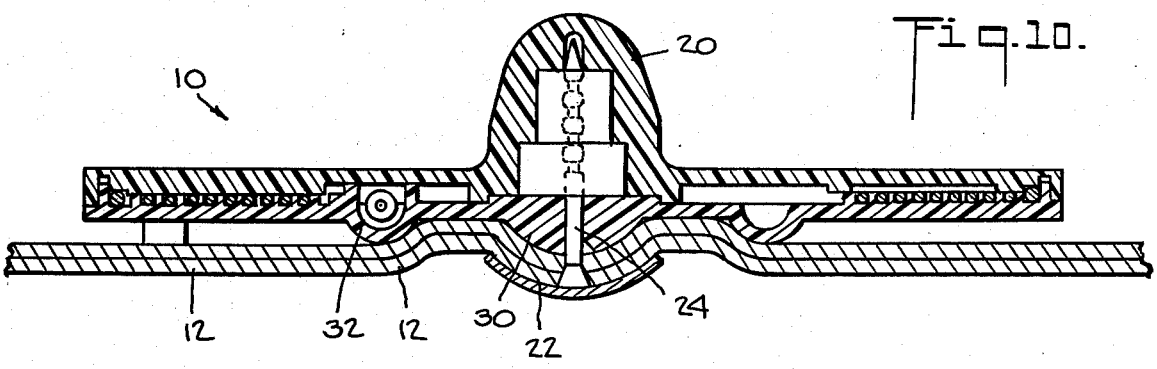
FIG. 10 is a view similar to FIG. 9 showing the wafer, article of merchandise and fastener fully assembled.

FIGS. 9 and 10 illustrate the application of the wafer of the present invention to an article of merchandise. As shown in FIG. 9, the fastener 14 is arranged with its pointed tip 26 facing one side of the article 12 with the wafer 10 being located on the opposite side of the article. The fastener 14 is then pushed against the article 12 so that its tip 26 and shank 24 pass through the article and into the central opening 28 of the wafer and into the wafer lock as shown in FIG. 11. As can be seen, the curved underside of the fastener head 22 cooperates with the rounded projection 30 on the wafer to bend the article 12 around the projection. As a result, the projection 30 telescopes or projects part way into the fastener head so that the fastener shank 24 is not accessible on either side of the merchandise 12 even when the merchandise is pulled back tightly around the fastener head 22. Consequently, it is extremely difficult, if not impossible, without cutting through the article 12 itself, to insert a tool between the fastener head and the wafer to sever the shank and obtain unauthorized removal of the wafer. The difficulty of obtaining access to the fastener shank is further increased in the wafer construction of the present invention by means of the rounded ridge 32, which, as shown in FIG. 11, causes the article to bend back up around the periphery of the fastener head.

It will be appreciated from the foregoing that the novel wafer and fastener construction of the present invention provides economy of manufacture, reliable electrical operation and security in its attachment to articles of merchandise.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by letters patent is:

1. A target wafer for use in an electronic theft detection system, said wafer comprising upper and lower members which are generally flat and coextensive and which are laminated to each other, one of said members having a continuous, spiral shaped groove formed in the surface thereof facing the other member, an elongated electrical conductor lying in said groove, a capacitor also contained between said members, said capacitor being electrically connected to said electrical conductor near each end thereof to form a resonant electrical circuit.

2. A wafer according to claim 1 wherein said electrical conductor is an uninsulated wire.

3. A wafer according to claim 1 wherein said electrical conductor is held tightly in said groove by the sides thereof.

4. A wafer according to claim 1 wherein said one member is formed with a recess surrounded by said groove and wherein said capacitor is contained within said recess.

5. A wafer according to claim 4 wherein said recess holds said capacitor to extend chordally with respect to said spiral groove.

6. A wafer according to claim 4 wherein said recess extends circumferentially around the center of said wafer.

7. A wafer according to claim 1 wherein an elongated hardened ring is also embedded in said wafer, said ring substantially encircling said coil.

8. A wafer according to claim 1 wherein said capacitor is provided with a first electrically conductive lead electrically connected to said conductor at the smaller diameter turn of said spiral groove and wherein said capacitor is provided with a second, longer, electrically conductive lead which extends across, but is electrically insulated from, said conductor except at the larger diameter turn of said spiral groove where it is electrically connected to said conductor.

9. A wafer according to claim 8 wherein said second lead is insulated from said conductor by a strip of electrically insulative tape interposed between said lead and said conductor.

10. A target wafer for use in an electronic theft detection system, said wafer comprising upper and lower members which are generally flat and coextensive and which are laminated to each other, one of said members having a continuous, spiral shaped groove formed in the surface thereof facing the other member, means forming an electrical circuit embedded within said spiral groove and capable of cooperating with an electronic theft detection system to produce characteristic signal disturbances, and a hardened metal ring also embedded inside said wafer and surrounding said electrical circuit to protect said circuit from damage due to severing of said wafer.

11. A target wafer according to claim 10 wherein said ring is formed with a gap to prevent electrical interference with said electrical circuit.

12. A target wafer according to claim 10 wherein said electrical circuit includes a flat coil and wherein said ring is formed of an elongated member having a cross section at least as great as the thickness of said coil.

* * * * *

UNITED STATES PATENT AND TRADEMARK OFFICE

CERTIFICATE OF CORRECTION

PATENT NO. : 4,187,509

DATED : February 5, 1980

INVENTOR(S) : Arnold Weiner

It is certified that error appears in the above-identified patent and that said Letters Patent are hereby corrected as shown below:

Sheet 1 of the drawings, change "Sheet 1 of 2" to
-- Sheet 1 of 4 --;

Sheet 2 of the drawings, change "Sheet 2 of 2" to
-- Sheet 2 of 4 --;

Add the attached two sheets of drawings containing Figs. 5, 6, 7 and 8.

Signed and Sealed this

*First* Day of *July 1980*

[SEAL]

*Attest:*

SIDNEY A. DIAMOND

*Attesting Officer*

*Commissioner of Patents and Trademarks*